United States Patent [19]

Schreiber

[11] Patent Number: 4,702,030

[45] Date of Patent: Oct. 27, 1987

[54] REVOLVER WITH FIRING ORDER INDICATOR NOTCHES

[76] Inventor: Paris H. S. Schreiber, General Delivery, Port Carling, Ontario, Canada, P0B 1J0

[21] Appl. No.: 898,523

[22] Filed: Aug. 21, 1986

Related U.S. Application Data

[62] Division of Ser. No. 704,584, Feb. 22, 1985.

[51] Int. Cl.[4] ..... F41C 1/00

[52] U.S. Cl. ..... 42/1.02

[58] Field of Search ..... 42/1.01, 1.02, 59, 62, 42/1.03, 1.04, 1.05

[56] References Cited

U.S. PATENT DOCUMENTS

| | | | |
|---|---|---|---|
| 784,786 | 3/1905 | Gottardi | 42/1.02 X |
| 790,634 | 5/1905 | Hirsh | 42/1.01 X |
| 3,407,526 | 10/1968 | Freed | 42/59 |
| 4,483,088 | 11/1984 | Tussing | 42/59 X |

*Primary Examiner*—Deborah L. Kyle
*Assistant Examiner*—Ted L. Parr

[57] ABSTRACT

Modifications are provded in the structure of firearms such as breech-loading revolver handguns. Traditionally, these firearms are constructed with mating surfaces in face to face contact, which surfaces must be separated for loading. Where foreign particles are trapped between the flat mating surfaces on closing, jamming results. In one aspect of the invention, these flat mating surfaces are provided with cavities, so that any such foreign matter will fall into the cavities and not prevent the closing of the firearm mechanism after loading. In another aspect of the invention, a series of small vee-type notches, discernible by touch, are formed around the rear edge of a rotary magazine or cartridge cylinder, in a descending sequence in direction opposite to the operative direction of rotation of the rotary magazine when in battery. Thus, during a firing sequence, the operator of the firearm is able to quickly discern the number of live cartridges remaining to be fired simply by running a finger over the vee-type notches and noting their location relative to the firing mechanism.

3 Claims, 6 Drawing Figures

REVOLVER WITH FIRING ORDER INDICATOR NOTCHES

CROSS-REFERENCE TO RELATED APPLICATION

This application is a division of my co-pending application Ser. No. 704,584, filed Feb. 22, 1985.

BACKGROUND OF THE INVENTION

This invention relates to modifications in the structure of firearms with movable magazine firing chambers, and is especially applicable to handguns having rotary magazine firing chambers.

Revolver pistols, such as double-action, swing-out revolving cylinder revolver handguns and break-open, breech-loading revolvers are examples of handguns with rotary magazine firing chambers which require separation of components at the firing mechanism for the purposes of loading.

The separable components are traditionally designed with mating surfaces which must come into face to face contact on closing the firing mechanism after loading.

However, a small grain of unburned powder, sand or other foreign particle which lodges between these mating surfaces during loading or during extraction and ejection of spent cartridges, will prevent the mechanism from fully closing with a fresh charge of cartridges, and will cause jamming of the firearm, preventing firing.

This is especially critical where such firearms are used under severe service conditions, since the jamming takes time to correct and often the lodged particle causing the problem is so small as not to be readily locatable for removal.

Also, although marksmen are taught to mentally number their rounds or shots as they are fired in order to keep track of the number of cartridges left unfired in the weapon, under actual service conditions, distractions and emotional pressures operate to defeat such orderly precautions. An operator may easily lose track and will be unable to quickly determine the number of unfired rounds remaining. Especially critical in a combat situation, the operator may be left suddenly and unexpectedly defenceless.

In a Model 99E Savage lever-action rifle, which has a rotary magazine with small numbers stamped on the forepart of the rotary spool holding the cartridges, a small hole through the right side of the receiver wall is aligned to allow viewing of the numbers stamped upon the rotating cartridge spool, as each number comes into view. The number showing will represent the number of unfired cartridges remaining in the magazine spool.

However, the numbering in this system is really only visible to an operator with good eyesight where the light is strong. The problem described above is not alleviated in poor light or in darkness.

Accordingly, it is an object of the present invention to provide modifications in the structure of firearms with rotary magazine cylinders firing chambers so as to render them much more reliable, especially under severe service conditions.

It is a further object of this invention to provide improvements in firearms, such as break-open and swing-out cylinder revolvers so that these firearms, when used with modern speed loaders will provide a superior handgun, in power, strength and reliability, to the semi-automatic pistol currently popular with the armed forces. It is preferable to use revolver handguns in combat because of their relative freedom from malfunctioning while firing. In the event of a cartridge misfiring, a further squeeze upon the trigger will fire another cartridge or round of ammunition. However, in the case of a semi-automatic pistol, misfiring of a cartridge or round necessitates loading a completely new round into the firearm, with resulting loss of valuable time.

SUMMARY OF THE INVENTION

In one aspect, the present invention provides a firearm having mating surfaces that separate at the magazine for loading, wherein at least one of the mating surfaces has a cavity therein for receiving foreign matter during loading.

In one embodiment, in the case of revolver handguns generally, cavities are provided between the rear surface of the cartridge holding cylinder firing chambers and the corresponding mating surface on the underside of the extractor-ejector which partially encircles the ends of the firing cartridge holding bores in the cylinder when closed for firing.

In another embodiment, in the case of revolver handguns having a moveable cartridge-holding member for loading, cavities are provided between the frame of the gunstock and the corresponding mating surface of a crane supporting the cartridge-holding member. In the case of revolvers, the cavities will be between the frame and the crane of the cylinder.

In another aspect of the invention, in a firearm with a rotary magazine firing cylinder such as a revolver, at least one indicator is provided on the rotary magazine cylinder. The indicator is discernible by touch when the rotary magazine firing chamber is in battery position ready for firing, and allows the operator to locate the position of the bore or firing chamber containing the cartridge which was first fired, relative to the firing mechanism of the firearm during a firing sequence. A sequence of indicators, in the form of a descending series of notches around the rotary magazine firing cylinder, can be used in place of a single indicator.

In addition, in order to position the indicator or notches on loading, a reference notch or similar means can be located on the shroud of the firearm, and it is preferable in this regard that all indicators and reference means are discernible visually as well as by touch.

DESCRIPTION OF THE PREFERRED EMBODIMENTS

Figure 1:
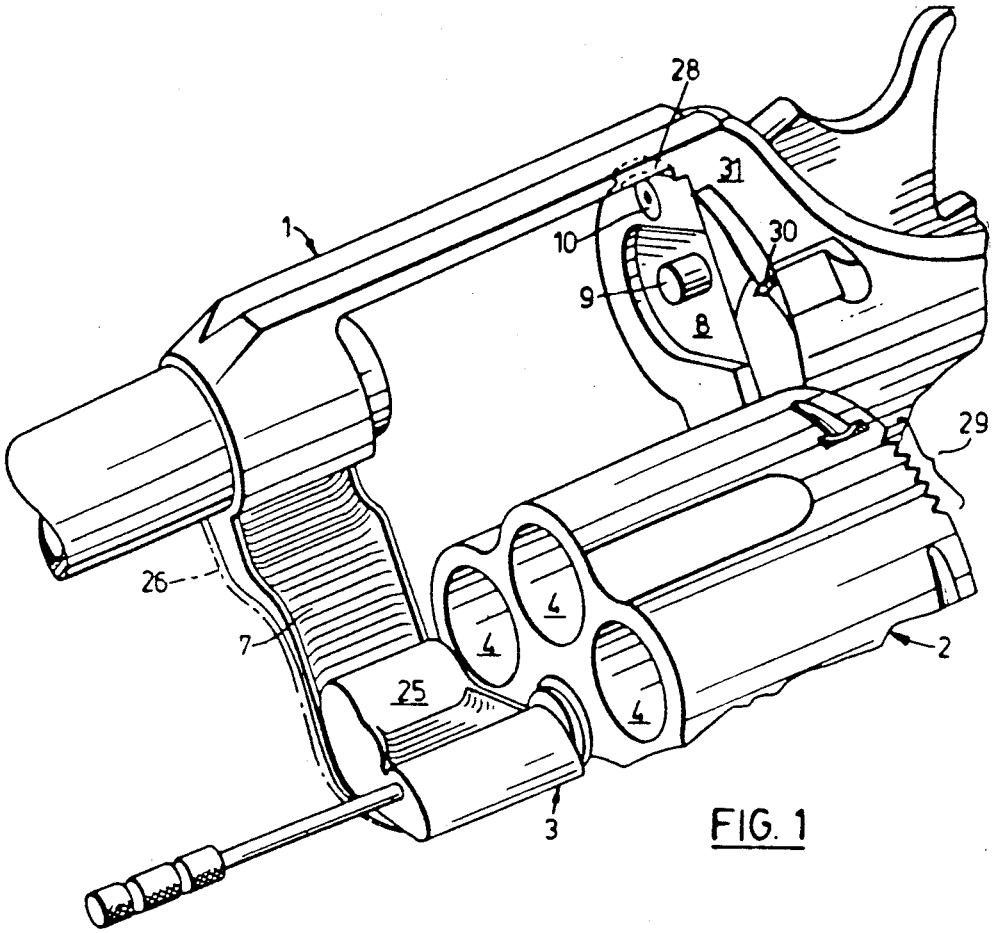
FIG. 1 is a side perspective, partial view of a double-action, non-counterbored revolver with a swing-out cartridge cylinder in open position for loading.

Referring now to FIG. 1, a gunstock frame 1 is provided having a rotary magazine in the form of a cartridge cylinder 2 rotatably mounted on a crane 3, which is in turn pivotally mounted on the frame 1.

The cartridge cylinder 2 is shown in cut-away view in FIG. 1 in open loading position with only three of the six cartridge bores 4 visible from the front face of the cartridge cylinder 2.

In operation, cartridges are loaded into the bores 4 from the rear face (not shown) of the cartridge cylinder 2. The cartridge cylinder 2 is then swung into battery position ready for firing by bringing the crane 3 against crane receiving surface 7 of the frame 1. A pressure yielding bolt 9 on the hammer face 8 of the frame yieldingly recedes into its aperture to allow a recess 27 (see FIGS. 5 and 6) to receive the bolt when the recess comes into line.

On firing, the cartridge located at or in front of the firing mechanism 10 is discharged. The cartridge cylinder 2 is rotated, generally in a clockwise direction, to bring the adjacent cartridge in front of the firing mechanism 10, by manually cocking the hammer fully, or by squeezing or drawing the trigger of the firearm fully to the rear. At this point the hammer trips, having been fully raised by the action of the trigger and falls, discharging the firearm.

Once all of the live cartridges loaded into the cartridge cylinder 2 have been discharged, the cartridge cylinder 2 may be released by activating a catch-release which causes the bolt 9 to recede into its aperture thus releasing the cartridge cylinder 2 from its locked position.

The cartridge cylinder 2 may then be swung into open loading position as illustrated in FIG. 1, by moving the crane 3 away from the crane receiving surface 7 of the frame 1.

Referring now to FIGS. 2, 3, 4, 5 and 6 the end of each bore 4 at the rear face 6 of the cartridge cylinder 2 is surrounded by a recess 5 within which, when a cartridge (not shown) is operatively disposed within the bore 4, an outwardly projecting annular lip at the end of the cartridge is disposed with this lip of the cartridge being flush with the rear face of the cartridge cylinder 2. Thus the cartridge cylinder is of the counterbored type.

Figure 5:
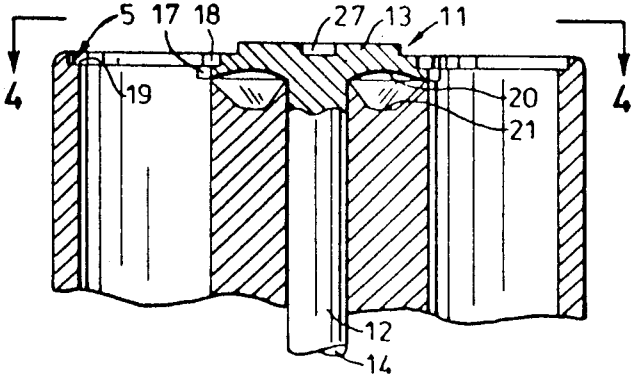
FIG. 5 is a cross-sectional view on the line 5—5 in FIG. 4 and also showing, in closed position the extractor-ejector.
Figure 6:
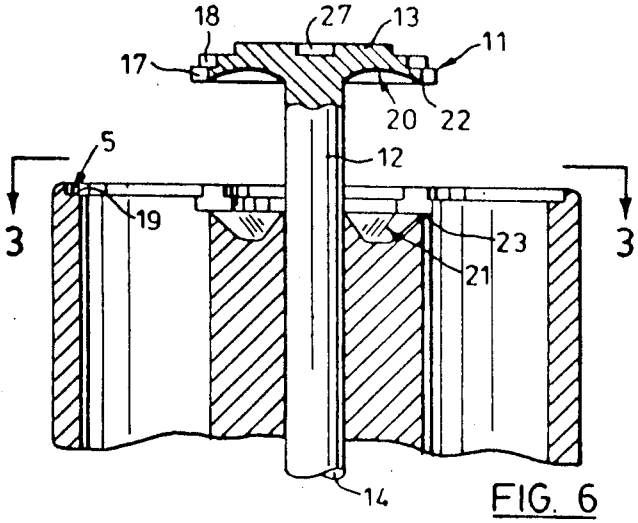
FIG. 6 is a view, similar to FIG. 5, taken along line 6—6 in FIG. 3, showing the extractor-ejector in open position.

An extractor-ejector 11 comprising a stem 12 and a rear flange 13 is provided with the stem 12 slidably mounted within a central bore 14 in the cartridge cylinder 2, so that the extractor-ejector 11 is moveable between a closed position (FIG. 5) and an open position (FIG. 6).

The stem 12 may be manually extended, as shown in FIG. 6, causing spring means (not shown) to compress. On releasing, the stem 12 is spring urged downwardly by said spring means which, forming no part of the present invention, have accordingly been omitted from the drawings for clarity.

For the same reason, the drawings have been simplified to omit anti-torque splines cut in the diameter of the stem 12, intended to mesh with grooves cut in the inner face of the bore 14, as well as other aspects of the mechanism of the extractor-ejector, which are conventional in various calibres and makes of revolvers and pistols.

The rear flange 13 of the extractor-ejector 11 is of circular form having a plurality of circumferentially spaced arcuate recesses 15 in the outer periphery thereof with outwardly projecting lugs 16 between the recesses. Each arcuate recess 15 is of stepped configuration and comprises an inner portion 17 the radius of which corresponds to that of each bore 4 and an outer portion 18 the radius of which corresponds to that of the recess 5 surrounding each bore. The rear face 6 of the cartridge cylinder 2 is so provided with a centrally disposed circular recess which intersects the bores 4 and the recesses 5 surrounding the bores 4 that, with the extractor-ejector 11 in its closed position shown in FIG. 5, the rear flange 13 of the extractor-ejector 11 is accommodated within said recess with the inner portion 17 of each annular recess 15 constituting a smooth continuation of the respective bore 4, the outer portion 18 of each annular recess 15 constituting a smooth continuation of the cylindrical wall of the recess 5 surrounding the respective bore 4, and the arcuate shoulder between the inner and outer portions 17, 18 of each arcuate recess 15 constituting a smooth continuation of the base 19 of the recess 5 surrounding the respective bore 4.

The extractor-ejector 11 must be in closed position when cartridges are loaded into the bores 4.

The lip of each cartridge will then rest on the arcuate shoulder at the particular bore 4, so that when the extractor-ejector 11 is moved to the open position of FIG. 5, each arcuate shoulder will catch the lip of its respective cartridge to lift the same out of the bore 4. This method of extracting cartridges is particularly useful for extracting spent cartridges after discharging them, in preparation for loading the bores 4 with fresh, live cartridges.

In the traditional construction of these revolvers, the underside surface 20 of the extractor-ejector 11 and the mating surface 21 of the rear face 6 of the cartridge cylinder are constructed flat, to come into face to face contact when the extractor-ejector is in closed position (FIG. 6).

Similarly, with reference to FIG. 1, the crane receiving surface 7 of the frame is, in traditional construction, in mating face-to-face contact with the corresponding inner surface 25 of the crane 3 when the cartridge cylinder 2 is in battery position.

Figure 4:
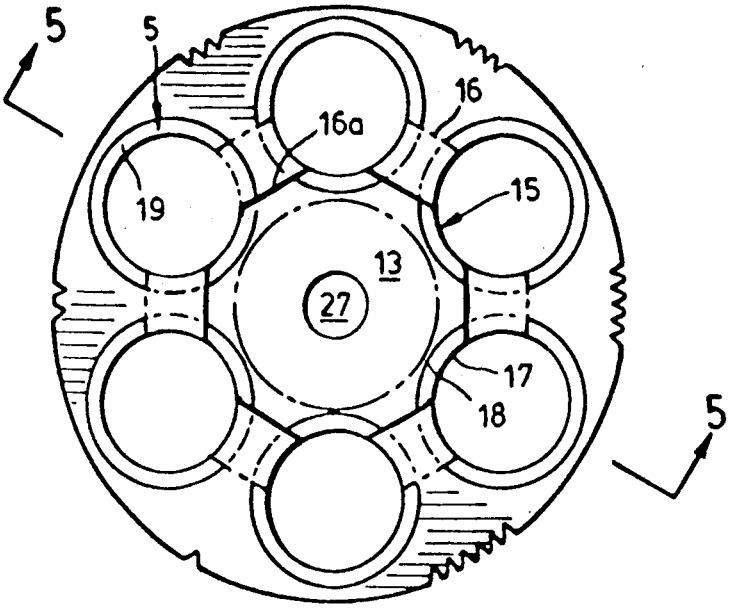
FIG. 4 is a view, similar to FIG. 3, showing the cartridge cylinder with the extractor-ejector in closed position.

As illustrated in FIGS. 4 and 5, the mating surfaces 20 and 21 are provided with cavities, according to one aspect of the invention, to provide an inner cavity between them for receiving foreign particles which may become lodged during loading. Such foreign particles will fall into the cavity created, and thus will not hinder full closing of the extractor-ejector.

It will be obvious from the foregoing, that a cavity can be created between the mating surfaces 20 and 21, either by providing a cavity in both surfaces or by providing a cavity in only one of them.

The cavities in both surfaces 20 and 21 and which may have a 45° slope in the walls thereof, are preferably provided with sharp edges which mate with one another. That is, sharp edges are formed at 22, by the cavity on the underside surface of the flange of the extractor-ejector 20, and also at 23 by the cavity formed on the surface 21 of the rear face 6 of the cartridge cylinder. These sharp edges perform a dual function; not only do they minimize the area of contact between the mating surfaces in order to minimize the risk of foreign matter being trapped therebetween, but they also cooperate to cut through any foreign matter caught between them, with the material trapped inside falling into the cavity, as described above.

Figure 2:
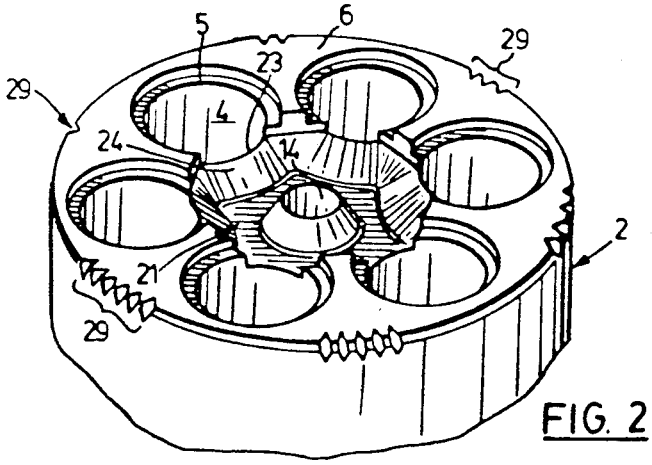
FIG. 2 is a perspective view of the rear face of the cartridge cylinder of a counterbored revolver with the extractor-ejector removed.
Figure 3:
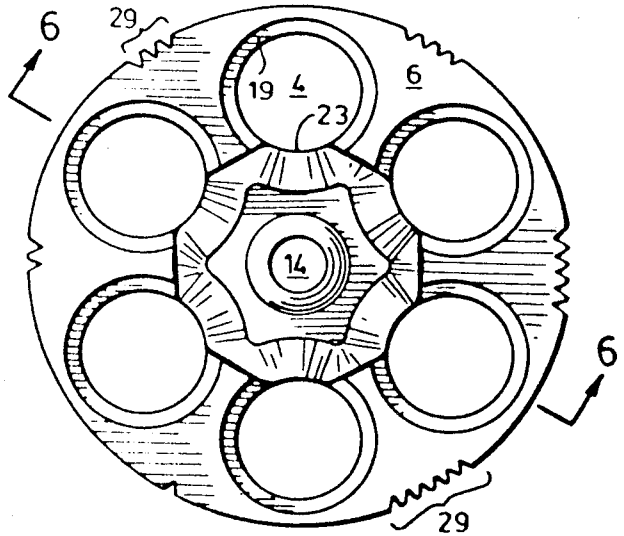
FIG. 3 is a top plan view of the cartridge cylinder of FIG. 2 with the extractor-ejector removed.

A similar 45° slope may also be utilised around the bore for the stem 12 of the extractor-ejector 11 to provide sufficient support to the stem against the pressure of discharging the firearm (FIG. 2). As described above, the minimization of surface area contact between the mating surfaces 20 and 21 maximizes the efficacy of the cavities to trap foreign matter, and thus prevent jamming.

FIG. 2 is a perspective view of the rear surface 6 of the cartridge cylinder. A preferred form of the cavity between the bores 4 and central bore 14 for receiving the stem of the extractor-ejector can be seen, although the precise configuration will vary according to the calibre and make of firearm used.

The cavity 21 is formed with inwardly-sloping walls 24 encircling a portion of the circumference of the bores 4. Although not shown in the figure, preferably one-third of the circumference of the bores 4 will be built out in this way. The walls facing into the cavity 21 around the bore are in the form of a hollowed cone, sloped toward an upper frustum. As the internal wall of the bore 4 is uniform, the wall 24 will increase in thickness in the direction away from the sharp edge 23. Accordingly, sufficient peripheral support against the pressure of discharge is ensured for the walls of said bores. Similarly, an allowance in the shape of a truncated cone with walls sloping toward an upper frustum, has been left around the central bore 14 for receiving the stem 12 of the extractor-ejector, again to provide sufficient support against the force of discharging the firearm.

As illustrated, the cavity 21 in the cylinder is preferably formed as a continuous cavity between the bores 4 and the central bore 14.

The bottom of the cavity has been shown as a flat surface, but it will be obvious from the foregoing description that other configurations will serve usefully.

FIGS. 2 through 6 illustrate one application of the present invention to counter-bored revolver handguns. The same principle may be applied to non-counterbored revolver handguns, as in FIG. 1, or to any other pistol or similar firearm having rotating magazine firing cylinders or other non-automatic magazines, requiring the separating and closing back together of mating surfaces.

However, it should be noted that the rear flange of an extractor-ejector on a counterbored revolver is generally about twice the thickness of that on a non-counterbored revolver. On some models of non-counterbored revolvers, the extractor-ejector may be too thin to reasonably accommodate a cavity capable of containing anything larger than a very small particle of foreign matter. In such cases, it may be preferable simply to provide a cavity in the cylinder head only to achieve an effective improvement.

In order to reduce the size of cavity necessary both in the underside surface 20 of the extractor-ejector 11 and in the mating surface 21 of the cylinder head, the circumferential extent around the bores 4 of the arcuate recesses 15 of the extractor-ejector 11 may be reduced from the usual encirclement of the bores by foreshortening the lugs 16 between the arcuate recesses 15. This is illustrated in FIG. 4 where one size of lugs 16 is shown in broken outline, while the foreshortened lugs **16*a*** are shown in solid outline.

In addition to reducing necessary size of cavity, the reduced length of lugs **16*a* will add strength to them and provide better support against a portion of the lugs 16 breaking off due to torque on the rotating cartridge cylinder 2** during priming.

In the case of revolver handguns with swing-out cylinders, as illustrated in FIG. 1, the cartridge cylinder 2 is rotatably mounted on a crane 3, which crane 3 swings the cartridge cylinder 2 into open loading position for discharging spent shells and re-loading. Once fresh cartridges have been loaded into the bores 4, the cartridge cylinder may be swung into battery or closed position, ready for firing, with the inner surface of the crane 25 meeting the crane receiving surface 7.

As noted above, traditionally, surfaces 25 and 7 are flat, promoting maximum contact therebetween. However, in the present invention, these inner surfaces are provided with cavities to receive particles of foreign matter and thereby prevent jamming due to failure to close properly.

It will be an obvious alternative, from the foregoing description, to provide a cavity in only one of surface 25 or surface 7.

Substantial cavities formed in surface 7 may weaken the strength of the frame. Accordingly, the frame may be thickened on its underside, as shown by the broken line 26, as necessary to reinforce the frame.

The revolver handgun shown in FIG. 1 is a non-counterbored revolver. However, it will be obvious that a similar cavity on the mating surfaces of crane and frame may be provided on counterbored revolver handguns or any other firearms utilising a comparable loading method.

On swinging the cartridge cylinder of a non-counterbored revolver handgun into battery position, a gap is left between the rear surface 6 of the cartridge cylinder 2 (not shown in FIG. 1) and the hammer face 8 of the frame. The gap accommodates the overhang of cartridge lips beyond the rear face 6 of the cartridge cylinder.

Providing cavities in the cylinder head and extractor-ejector may weaken the structure of the non-counterbored revolver, and misalignment may be caused by movement of the cylinder against the revolver frame under the impact of the recoil caused by firing. A recoil shoulder 28 is provided to abut the cylinder-head when the cylinder swings in and home, thereby providing a support for the cylinder against the recoil of discharge.

The preferred placement of the recoil shoulder 28 is as shown in FIG. 1, although a single or second recoil shoulder could be provided to abut the cylinder at other locations on the frame, as long as closing of the cartridge cylinder 2 and the hammer face 8 of the frame is not impeded. By way of example, it is pointed out that one alternate location for the recoil shoulder would be at the bottom of the hammer face 8 of the frame i.e. opposite the shoulder 28.

In the case of a counterbored revolver handgun, the cartridge lips lie flush with the rear surface 6 of the cartridge cylinder 2 and no gap is left between the rear surface 6 of the cartridge cylinder 2 and the hammer face 8 of the frame. Hence, it can be seen that the recoil shoulder has specific application to non-counterbored revolvers and similar firearms in which such a structure may be necessary to prevent misalignment.

FIGS. 1, 2, 3 and 4 also illustrate the aspect of my invention directed to a system for easy identification of the number of live cartridges remaining in the cylinder at any time.

Small vee-type notches 29 are made on the cartridge cylinder 2 around the edge of the rear face 6 thereof (FIG. 1).

It can be seen from FIG. 2 that the notches 29 are located between the bores or firing chambers in decreasing counter-clockwise sequence from six notches to one notch.

When the cartridge cylinder 2 is closed in battery position for firing, it is placed with the highest number of notches opposite a reference notch 30 on the shroud 31, at a position immediately to the rear of the cartridge cylinder. The reference notch 30 facilitates placing the cartridge cylinder by touch alone, in the correct sequence in relation to loading and in battery position. In good light, the notches can easily be located visually.

As each round is discharged, the cartridge cylinder will rotate clockwise, and one less notch will appear opposite the reference notch 30. The operator can simply run a thumb-nail over the vee-type notches 29 opposite the reference notch 30, to ascertain immediately and keep track of the number of unfired cartridges remaining in the cartridge cylinder 2.

The cavities of my invention may be formed entirely by conventional grinding or other methods obvious to a skilled gunsmith or manufacturer. However, I envisage the best method of forming all of the cavities and the recoil shoulder would be by the investment casting process with, if necessary, the cavities being finished by grinding.

In the case of the vee-type notches, these could also be formed during manufacture of the firearm through the investment casting process. On existing firearms, the vee-type notches could easily and inexpensively be added using any tools of a gunsmith appropriate for this purpose. The vee-type notches are very easy to make and do not take any precision machining, so that even an amateur gunsmith would be capable of forming them.

In addition, it should be understood that the present disclosure is for illustration only and includes all modifications and improvements, both to the structures described and to other structures, which fall within the scope of the appended claims.

I claim:

1. A revolver with a firing mechanism and a cylinder containing a plurality of firing chambers, the cylinder being moveable between a loading position for inserting live cartridges into the firing chambers and a battery position for firing, wherein said cylinder has a sequential series of indicators corresponding to a firing sequence of the firing chambers from a first firing chamber to a last firing chamber, which indicators are discernible by touch when the cylinder is in the battery position whereby the location relative to the firing mechanism of each of the firing chambers in the firing sequence can be discerned by touch.

2. A revolver, according to claim 1, wherein said series of indicators comprise rows of vee-type notches on the cylinder between each of said firing chambers, and wherein the numbers of notches in the rows thereof are in descending sequence in a direction opposite to the operative direction of rotation of the cylinder when in the battery position.

3. A revolver, according to claim 1, further comprising a shroud for receiving said cylinder in the battery position, and wherein said shroud has a reference notch which is discernible by touch for positioning the series of indicators to locate the first firing chamber in a position for first firing when the cylinder is initially moved into the battery position from the loading position.

* * * * *